United States Patent [19]

Lawrence

[11] 3,939,576

[45] Feb. 24, 1976

[54] LOW FRICTION PRESSURE SEAL FOR FABRIC PROCESSING CHAMBER

[75] Inventor: Jackson Lawrence, West Sand Lake, N.Y.

[73] Assignee: Cluett, Peabody & Co., Inc., New York, N.Y.

[22] Filed: July 19, 1974

[21] Appl. No.: 490,199

[52] U.S. Cl. ..... 34/242; 68/5 E; 277/237 R

[51] Int. Cl.[2] ..... F26B 25/00

[58] Field of Search..... 34/15, 242, 155; 68/5 E; 432/242; 277/237 R, DIG. 7, 226

[56] References Cited

UNITED STATES PATENTS

| | | | |
|---|---|---|---|
| 2,298,906 | 10/1942 | Sperry | 34/242 |
| 2,420,537 | 5/1947 | Guenther et al. | 68/5 E |
| 2,986,912 | 6/1961 | Richeson et al. | 34/242 |
| 3,302,432 | 2/1967 | Woollatt et al. | 34/242 |
| 3,343,379 | 9/1967 | Duis et al. | 34/242 |
| 3,645,116 | 2/1972 | Peter | 68/5 E |
| 3,843,142 | 10/1974 | Lopata | 34/242 |

*Primary Examiner*—Kenneth W. Sprague
*Assistant Examiner*—James C. Yeung

[57] ABSTRACT

A chamber seal is provided, which accommodates the entry into and exit from a processing chamber for a web of fabric. The seal serves to minimize the flow of gases into or out of the chamber, while at the same time minimizing frictional drag on the fabric, so that the fabric may be processed without excessive tension. The invention is especially useful in connection with processing of fabrics with liquid ammonia.

The low pressure seal includes a guide member which engages and guides one surface of the fabric. The opposite surface of the fabric is contacted by a thin, flexible web of low friction material, such as Teflon-impregnated glass fiber cloth. The sealing web, which is highly flexible and conformable, is urged into contact with the fabric by means of a slightly compressed resilient tubular element, which is supported opposite the fabric guide. To advantage, the resilient element is not inflated, but provides the desired low pressure sealing force by reason of a slight deformation. The low friction web material is free of the resilient element and, in some cases, is movable relative thereto, in order to provide a renewed surface. In some cases, a single web of low friction sealing material may provide a plurality of sealing surfaces at a plurality of openings.

3 Claims, 3 Drawing Figures

LOW FRICTION PRESSURE SEAL FOR FABRIC PROCESSING CHAMBER

BACKGROUND AND SUMMARY OF THE INVENTION

In the processing of fabrics with liquid ammonia, a web of the fabric is directed into a closed chamber, in which the fabric is contacted by the liquid ammonia. Typically, this may be accomplished by directing the fabric web into a trough containing liquid ammonia and then conveying the fabric under controlled conditions while the fabric remains saturated with the ammonia. The primary treatment chamber is, in such cases, saturated with ammonia vapor.

Because of the poisonous and unpleasant nature of the ammonia vapors, it is desirable to maintain the interior of the treating chamber at a slightly negative pressure relative to the ambient, so that leakage out of the chamber is avoided or minimized. At the same time, it is desirable to avoid leakage into the chamber of excessive atmospheric air. Excessive influx of air can introduce undesirable amounts of moisture, which can interfere significantly with ammonia recovery procedures. Likewise, too much air in the system can be detrimental.

The present invention provides simple yet highly reliable and effective means for sealing the entrance and discharge openings of a liquid ammonia or similar treatment chamber. Importantly, the new sealing arrangement provides for effective sealing of the entry and discharge openings of the chamber without resulting in excessive frictional drag on the fabric being conveyed therethrough. The latter can be an important consideration in the processing of knitted fabrics, for example, where it is desired to carefully limit and control fabric tensions during the processing.

In the pressure seal of the invention, opposite surfaces of the fabric are maintained in sliding contact with effectively stationary surfaces of the seal. On one side, the seal can be formed by a rigid guide member. On the opposite side, the seal is formed by a thin, highly flexible web of low friction material, such as Teflon-impregnated glass fiber cloth. This thin, flexible material is urged lightly against the fabric by a deformable resilient member. The construction of the seal is such as to provide highly effective closure of the chamber while at the same time maintaining frictional drag on the fabric at a practical minimum and also highly uniform across the width of the fabric.

In accordance with one aspect of the invention, the flexible low friction web material is movably mounted, enabling it to be shifted from time to time to bring a new surface area into operative position as may be necessary to compensate for wear.

In a typical processing chamber, the entrance and exit openings may incorporate double seals, with an intervening zone between the interior and exterior of the treatment chamber. In such cases, a pair of sealing assemblies may be utilized in conjunction with a single length of the low friction web material, for convenience and greater simplicity.

For a more complete understanding of the above and other features of the invention, reference should be made to the following detailed description of a preferred embodiment, and to the accompanying drawings.

DESCRIPTION OF A PREFERRED EMBODIMENT

Figure 1:
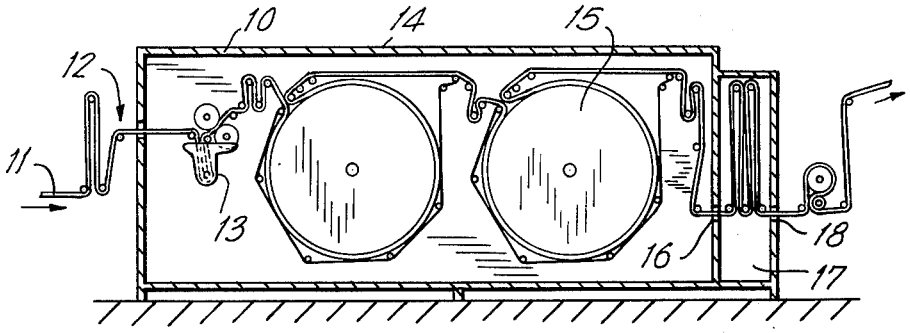
FIG. 1 is a simplified schematic representation of a liquid ammonia processing chamber incorporating the improved low pressure seal of the invention.

Referring now to the drawings, the reference numeral 10, designates a representative treatment chamber for carrying out a liquid ammonia treatment process on a fabric web 11. The fabric is conveyed into the chamber through an entrance opening, generally designated by the numeral 12 and, within the chamber, is guided through a processing trough 13, containing liquid ammonia. After a short period provided for the ammonia reactions to take place, the fabric may be directed onto dryer drums 14, 15, to drive off the ammonia, and out through a chamber discharge opening 16, which also constitutes the entrance to a steam chamber 17. The steam chamber has a discharge opening 18 from which the fabric web emerges and is conveyed away to be further processed.

Figure 2:
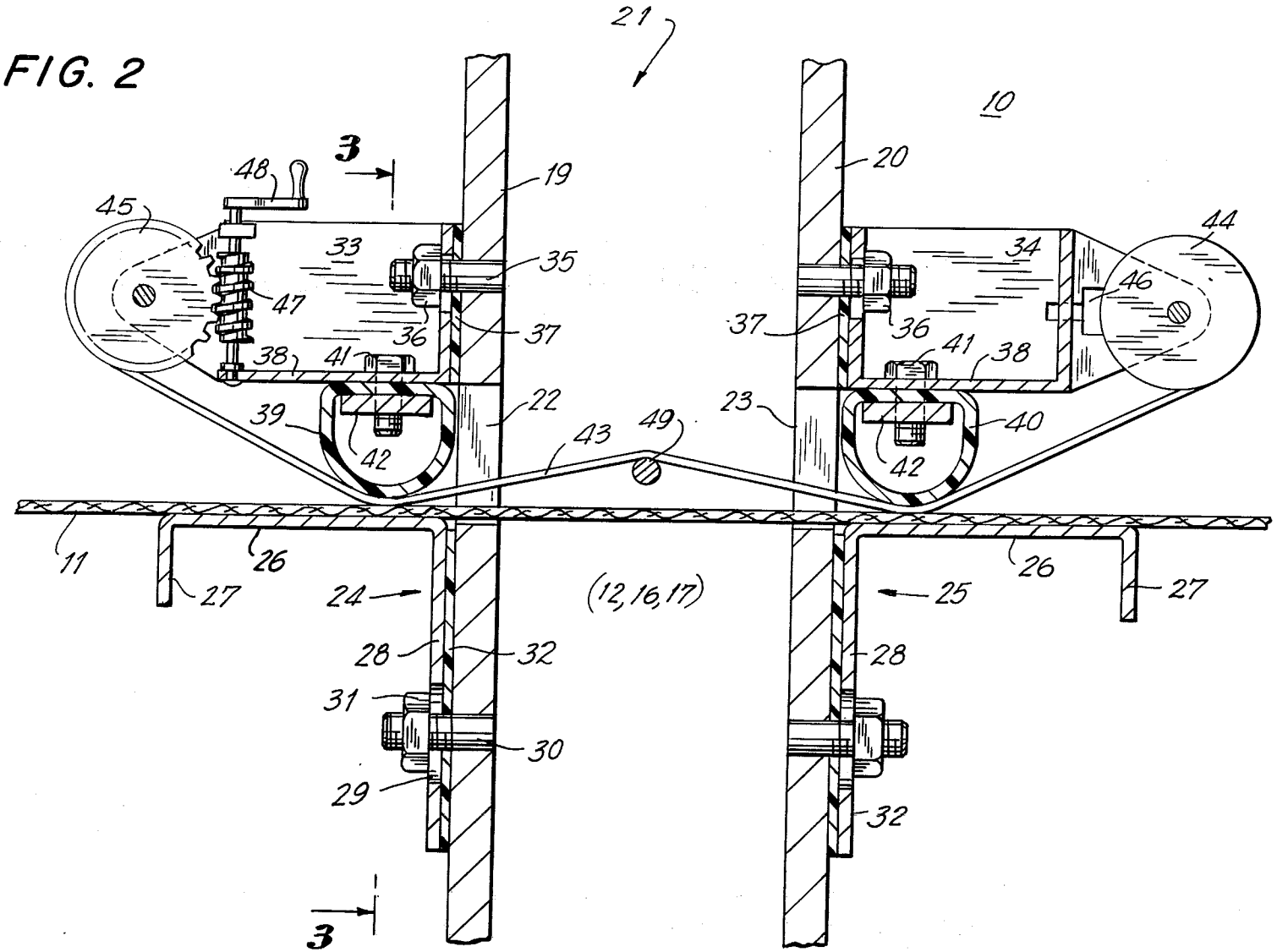
FIG. 2 is a greatly enlarged, cross-sectional view of an entrance or exit opening of the processing chamber of FIG. 1, illustrating the utilization therein of the new sealing arrangement.

As reflected in FIG. 2, the entry or discharge openings 12, 16, 18, advantageously are arranged to provide a gas lock, to minimize escape of ammonia vapors from the treatment chamber 10 and also to minimize ingress of ambient air into the chamber. To this end, the chamber 10 is provided, at least in the area of the openings 12, 16, 18, with spaced walls 19, 20. In the specific illustration of FIG. 2, the area to the left of the outer wall 19 represents the ambient atmosphere, and the area to the right of the inner wall 20 represents the ammonia atmosphere within the treatment chamber. The area 21 in between forms the desired gas lock.

In a typical liquid ammonia treatment system, the interior of the chamber may be maintained at a negative pressure, relative to ambient, of about 0.5 inch $H_2O$. The gas lock area 21, in such case, may be maintained at a negative pressure of about 0.75 inch $H_2O$. This provides for a limited leakage of ammonia vapors from the processing chamber into the gas lock chamber 21, because of the slightly more negative pressure therein. Air leakage from the ambient will tend to be restricted to the gas lock chamber, minimizing the entry of air into the interior of the main treatment chamber. The entry of air into the main treatment chamber cannot be precluded altogether, of course, inasmuch as some quantities of air are contained in the interstices of the fabric itself. Thus, in a continuous process even under theoretically ideal conditions, some air will enter the main chamber. Suitable means (not shown) are provided to exhaust the gas lock chamber 21, so that the ammonia vapors therein are constantly conveyed away for recovery or disposal.

In the illustrated arrangement, each of the chamber walls 19, 20, is provided with an elongated, narrow opening 22, 23 of suitable width to receive a fabric web 11 of maximum intended width. In a typical installation, the openings 22, 23 will be horizontal.

Figure 3:
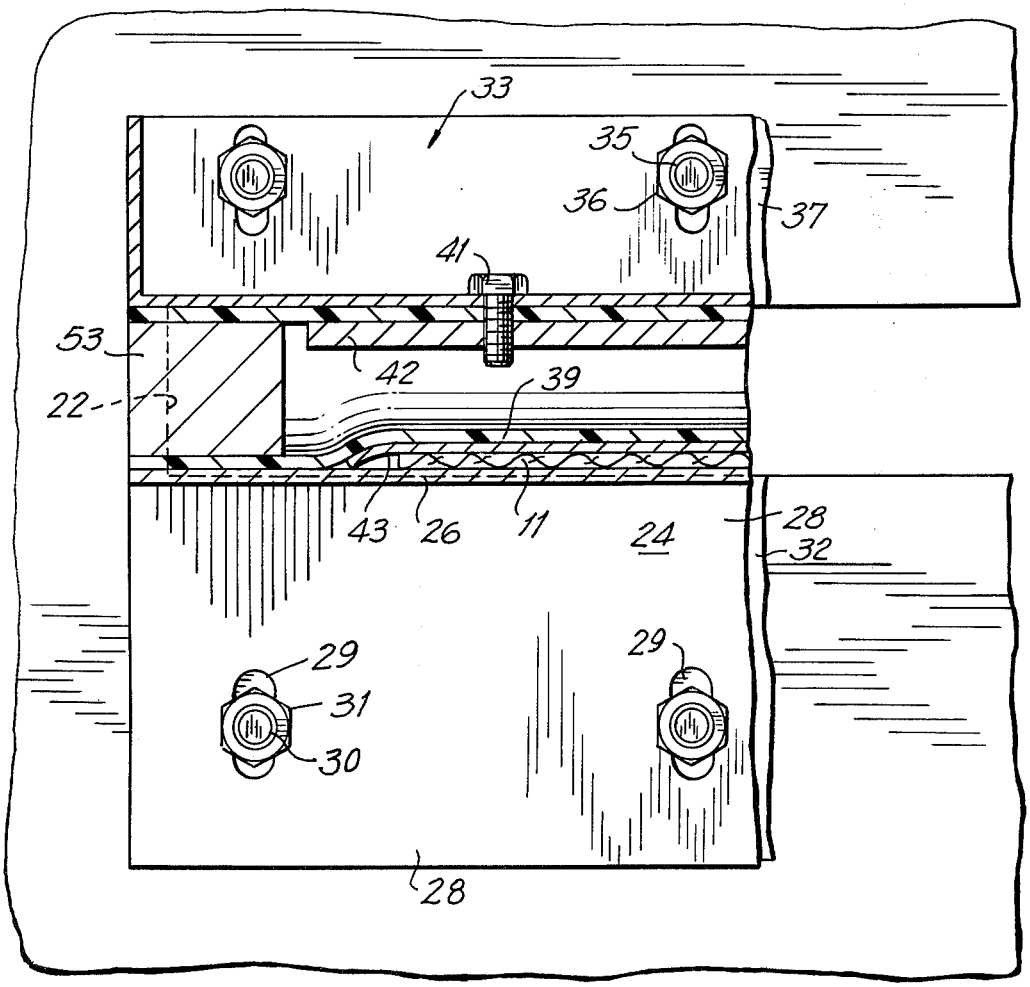
FIG. 3 is an enlarged, fragmentary, cross-sectional view, as generally taken on line 3—3 of FIG. 2.

Secured to the walls 19, 20, adjacent and below the respective openings 22, 23, are fabric guide members 24, 25. To advantage, the guide members are formed of stainless steel sheet material, shaped to provide a horizontal guide platform section 26, a depending outer lip 27 and a downwardly extending inner panel section 28. The respective guide members 24, 25, are of a suitable length to extend across the full width of the openings 22, 23, and desirably somewhat beyond on each end, as reflected in FIG. 3.

The panel portions 28 of the guide members are provided with vertically elongated slots 29, at spaced locations across the width of the guide members, which receive studs 30, welded or otherwise secured to the respective chamber walls 19, 20. The arrangement is such that the guide members 24, 25 may be secured with limited vertical adjustability to the respective chamber walls, by means of nuts 31. Resilient gasket elements 32, desirably may be interposed between the guide members 24, 25 and the chamber walls for improved sealing.

As reflected in FIG. 2, the guide members 24, 25 are adjusted and secured to the walls 19, 20 in a position such that their platform sections 26 lie generally in a horizontal plane, slightly above the lower edges of the wall openings. Desirably, the platform sections will be arranged to lie in a common plane; however, that is not strictly necessary in view of the flexible nature of the fabric web.

Secured to the walls 19, 20, above the elongated openings 22, 23, are mounting brackets 33, 34. These may be secured by studs 35 and nuts 36, with slotted openings providing limited vertical adjustability. Resilient gasket means 37 is interposed between the brackets 33, 34 and the adjacent chamber walls.

In accordance with the invention, there are secured to the lower flanges 38 of the respective brackets 33, 34 elongated, resilient compression elements 39, 40. To advantage, these compression elements are formed of elongated tube-like sections of rubber or similar elastic material, which extend along the openings 22, 23, for the full width thereof and slightly beyond the ends of the openings. As reflected in FIG. 2, the tubular elements 39, 40 are positioned closely adjacent the surfaces of the chamber walls 19, 20, enabling the end extremities of these resilient elements to be utilized for sealing the end regions of the openings, as will be more fully described. The resilient compression elements 39, 40 are of relatively thin walled construction, and thus are readily deformable under radial compression. As reflected in FIG. 2, the compression elements 39, 40 are secured to the brackets 33, 34 by bolts 41, which extend through the sealing elements and engage elongated clamping strips 42 extending therethrough.

As a significant feature of the invention, there is interposed between the lower surfaces of the resilient compression elements 39, 40 and the guide members 24, 25 a thin, highly flexible web 43 of a low friction material. Desirably, the web 43 may be a material such as glass fiber cloth, which has been impregnated with a low friction materil such as Teflon (polytetrafluoroethylene). The web 43 extends substantially across the full width of the openings 22, 23, and is at least as wide, desirably somewhat wider, than the maximum width of web material 11 to be accommodated.

As shown in FIG. 2, the fabric web 11 enters or exits from the processing chamber by passing between the guide members 24, 25 and the low friction web material 43. The initial vertical adjustment of the respective guide members 24, 25 and the mounting brackets 33, 34 is such that, with the fabric 11 supported by the guide members 24, 25, the resilient pressure elements 39, 40 are at least slightly deformed and compressed, and thereby serve to lightly press the low friction web material 43 against the fabric 11. The web material 43 is substantially impermeable and thus forms an effective gas seal between the compression members 39, 40, and the respective opposing guide members 24, 25. In this respect, it will be understood that sealing pressure is derived from elastic deformation of the elements 39, 40, under compression, rather than, for example, by internally inflating the pressure members, because the former procedure provides for more delicate control of pressures on the fabric (and thus lengthwise tensions), while at the same time providing for adequate and effective sealing.

Adjacent the ends of the wall openings 22, 23, shaping blocks 53 are inserted in the ends of the compression elements 39, 40, to effect a transition in the shape of the elastic elements and enable them to effectively seal the openings at their ends.

In one advantageous form of the invention, a single, continuous web of the low friction material 43 extends through both of the wall openings 22, 23 and cooperates with both of the compression elements 39, 40. In addition, since the low friction web material 43 is subject to wear with continued usage, arrangements are provided to accommodate repositioning of the web 43 from time to time, to bring fresh surface areas into the regions of contact, underneath the compression elements 39, 40. To advantage, the repositioning of the low friction web material 43 may be accomplished by providing a supply reel 44 of the material, carried by the bracket 34 within the treatment chamber 10, and a take up reel 45 secured to the bracket 33 on the outside of the chamber. The supply reel 44 may be held normally nonrotatable, as by means of a brake device 46, while the take up reel 45 may be controllably movable by any suitable means, such as a worm gear 47 and crank 48. As limited areas of the low friction web material become worn, the take up reel may be advanced slightly, to bring new areas underneath the respective compression elements 39, 40, as will be readily understood.

When using a single length of web material to provide low friction sealing at both of the openings 22, 23, it may be desirable to provide a guide bar 49, within the gas lock chamber 21, to divert the sealing web 43 away from the fabric 11 in the region between the two compression elements 39, 40, to both minimize wear on the sealing web 43 and reduce drag on the fabric 11.

The chamber seal of the invention, although of a highly simplified and economical nature has proven to be uniquely effective in practice. The seal effectively limits the undesired flow of gases at the chamber openings, but at the same time maintains drag on the fabric 11 at a minimum practical level, to minimize fabric tensions and distortions during processing. In its most elementary form, the seal utilizes a non-inflated, elastically distortable compression element of rubber or similar elastic material, in conjunction with an interposed low friction contact surface, in the form of a thin, flexible low friction web. Fabric enters the seal by passing between a fixed guide member and the low friction web material, with the latter being pressed lightly against the fabric to form the desired seal, while maintaining a low friction contact with the fabric to permit its movement in the absence of excessive tension.

In a typical liquid ammonia processing chamber, double seals are employed at some or all of the chamber openings, in which case it is both convenient and advantageous to utilize a single length of the flexible, low friction web material in conjunction with a pair of adjacent seals. In all cases, the flexible sealing web is secured in a manner to permit it to be moved longitudinally from time to time, to bring fresh surface areas underneath the compression elements, as the areas in use become worn. A substantially continuous supply and take up arrangement may be utilized for this purpose.

It should be understood, of course, that the specific form of the invention herein illustrated and described, is intended to be representative only, as certain changes may be made therein without departing from the clear teachings of the disclosure. Accordingly, reference should be made to the following appended claims in determining the full scope of the invention.

I claim:

1. A low-friction, low pressure seal for use in combination with a processing chamber for the continuous liquid ammonia processing of fabrics, wherein the chamber is maintained at a slight negative pressure in relation to the surrounding ambient and wherein the fabric is conveyed through the chamber with minimum tension applied at the seal, wherein the seal comprises and is characterized by a. means forming a smooth stationary rigid guide member mounted in the region of the chamber opening, for engaging, guiding and supporting one surface of the fabric web as it passes through the opening, b. said guide member extending across the full width of the opening, c. a stationary seal support mounted in spaced, parallel relation to said guide member and defining therewith a web passageway associated with said chamber opening, d. an elongated, resilient, hollow, deformable sealing member carried by said stationary seal support and extending toward said guide member, e. said deformable sealing member extending across the full width of said opening, f. a thin, flexible, web-like section of low friction material secured in normally stationary manner in a region spaced from said deformable sealing member and extending between said sealing member and said rigid guide member, g. said web-like section being urged lightly toward said guide member by said sealing member, h. said resilient sealing member being maintained free of internal inflation pressures, whereby sealing pressures applied by said sealing member are derived exclusively by limited elastic deformation of said sealing element, whereby said fabric can be advanced with a minimum of tension resulting from said seal, and i. said low pressure seal being adapted for the low resistance passage of a fabric web between and in sealed relation with said guide member and said section of low friction material.

2. A low-friction, low pressure seal according to claim 1, further characterized by a. said chamber having spaced inner and outer walls and having spaced openings therein forming a double sealed passage into or out of the chamber.

b. the region between said walls being maintained at a slightly more negative pressure than the interior of said chamber, c. a seal, as specified in claim 1, being provided for each of said spaced openings, and d. a single section of thin, flexible sheet-like low-friction material extending through said passage, spanning the space between said walls, and forming part of each of said seals.

3. A low-friction, low pressure seal according to claim 2, further characterized by a. said section of low friction material being movable through the passage to permit unworn areas to be brought into operative position as needed, b. means mounted on said chamber and engaging said low-friction material for advancing said material through said passage.

* * * * *